US005955233A

United States Patent [19]

Urashima et al.

[11] Patent Number: 5,955,233

[45] Date of Patent: Sep. 21, 1999

[54] TONER BINDER RESIN AND STATIC CHARGE DEVELOPING TONER USING THE RESIN

[75] Inventors: Nobuaki Urashima, Nara; Mitsuo Kushino; Tatsuhito Matsuda, both of Hyogo, all of Japan

[73] Assignee: Nippon Shokubai Co., Ltd., Osaka, Japan

[21] Appl. No.: 08/817,893

[22] PCT Filed: Aug. 6, 1996

[86] PCT No.: PCT/JP96/02202

§ 371 Date: Jun. 23, 1997

§ 102(e) Date: Jun. 23, 1997

[87] PCT Pub. No.: WO97/07431

PCT Pub. Date: Feb. 27, 1997

[30] Foreign Application Priority Data

| | | | |
|---|---|---|---|
| Aug. 11, 1995 | [JP] | Japan | 7-206230 |
| Mar. 27, 1996 | [JP] | Japan | 8-072801 |

[51] Int. Cl.[6] ..... G03G 9/087

[52] U.S. Cl. ..... 430/109; 430/106.6; 430/137

[58] Field of Search ..... 430/109, 137

[56] References Cited

U.S. PATENT DOCUMENTS

| | | | |
|---|---|---|---|
| 4,455,360 | 6/1984 | Ishikawa et al. | 430/109 |
| 4,910,114 | 3/1990 | Hosino et al. | 430/109 |
| 5,384,226 | 1/1995 | Kanakura et al. | 430/137 |
| 5,413,890 | 5/1995 | Mori et al. | 430/137 |
| 5,470,687 | 11/1995 | Mayama et al. | 430/137 |

FOREIGN PATENT DOCUMENTS

| | | |
|---|---|---|
| 59-129862 | 7/1984 | Japan . |
| 61-117564 | 6/1986 | Japan . |
| 62-210473 | 9/1987 | Japan . |
| 63-44665 | 2/1988 | Japan . |
| 63-74072 | 4/1988 | Japan . |
| 3-80260 | 4/1991 | Japan . |
| 6-27731 | 2/1994 | Japan . |
| 7-165847 | 6/1995 | Japan . |
| 8-152739 | 8/1995 | Japan . |

*Primary Examiner*—Roland Martin
*Attorney, Agent, or Firm*—Fish & Richardson P.C.

[57] ABSTRACT

A static charge developing toner excelling in resistance to offset and low-temperature fixing property and using as at least part of a binder resin component an epoxy resin-including binder resin which is obtained by polymerizing a polymerizable monomer in the presence of an epoxy resin.

7 Claims, No Drawings

TONER BINDER RESIN AND STATIC CHARGE DEVELOPING TONER USING THE RESIN

TECHNICAL FIELD

This invention relates to a binder resin for toner and a static charge developing toner using the resin. More particularly, this invention relates to a toner binder resin fit for the production of a static charge developing toner which, when used for the development of an electrostatic latent image formed by such means as the electrophotographic method, the electrostatic recording method, the electrostatic printing method, and the like, can form a fixed image stable at low temperatures and incapable of inducing offset and which exhibits excellent stability during storage.

BACKGROUND ART

In the field of electrophotography, the heating roller method has been widely disseminated as a means for enabling a toner image formed on an image receiving sheet to be permanently fixed on the sheet.

This method is exceptionally fit for an electrophotographic copying device because the surface of a heating roller tightly contacts the image surface of the image receiving sheet and consequently the thermal efficiency with which the toner image is thermally fused to the image receiving sheet is so perfect as to permit quick fixation of the image.

In recent years, the electrophotographic copying devices of this class have come to demand a cut in power consumption and an addition to operating speed and have consequently created a need for a toner capable of being fixed at low temperatures.

In order that a given toner may be rendered fixable at low temperatures, the toner requires to lower the melting temperature thereof. It is, therefore, conceivable to use a resin of a low melting point such as, for example, a vinyl chloride resin as the binder resin component incorporated in the toner or to increase the content of a (meth)acrylic ester component in a styrene-(meth)acrylic resin, for example.

Indeed the use of this resin enables the melting point of the toner to be lowered. It nevertheless has the possibility of narrowing the temperature range in which the toner can be fixed without inducing either low-temperature or high-temperature offset (hereinafter referred to occasionally as "non-offset range") or failing to offer a fully satisfactory toner fixing ratio.

JP-A-61-117,564 discloses a so-called pulverized toner obtained by melting and kneading a binder resin with a coloring agent and other components and pulverizing the resultant blend and classifying the produced particles, which pulverized toner is characterized by containing as basic resins 90–30% by weight of an epoxy resin having a weight average molecular weight of not less than 2000 and 10–70% by weight of a styrene-acryl resin having a weight average molecular weight of not less than 50000 for the purpose of allowing the produced pulverized toner to enjoy fully satisfactory pulverizability, avoid emitting any offensive odor during the course of fixation, manifest perfect fixability, and produce only sparing fogging during the course of printing.

JP-A-59-129,862 discloses a flash fixing toner such that an image formed of this toner is fixed by a procedure of exposing this image to an ultraviolet light of high energy and a visible radiation thereby elevating the temperature of the toner in the image instantaneously to the melting point thereof, which flash fixing toner is obtained by composing a binder resin combining 100 parts by weight of an epoxy resin having a weight average molecular weight of 1000–10000 with 10–50 parts by weight of an ethylene-n-butyl acrylate resin having a weight average molecular weight of 10000–100000 for the sake of appropriate adhesiveness of the toner resin to the surface of a sensitive plate and for the purpose of preventing the flash fixed image from producing a void and then pulverizing the resultant binder resin.

Though it has been known in the art to use the epoxy resin as part of the binder resin in the toner of the kind under discussion, it has never been known to the art to use the epoxy resin for the purpose of enabling the toner to be fixed at low temperatures.

In the case of the so-called polymerized toner resorting to the suspension polymerization, the emulsion polymerization, or the like which is regarded as advantageous because of the uniformity and the fineness of the toner particles, the qualities yearned for in the light of the stability of charging of the toner and the high degree of resolution of the toner image, it has been heretofore considered difficult to incorporate the epoxy resin mentioned above in this polymerized toner by reason of the method of polymerization used for the epoxy resin.

DISCLOSURE OF THE INVENTION

This invention, therefore, has for an object thereof the provision of an improved binder resin for toner and a static charge developing toner using the binder resin. This invention has another object of providing the binder resin for the production of a low-temperature fixing toner which excels in resistance to offset, fixing property, and stability during storage.

The objects mentioned above are accomplished by a toner binder resin including an epoxy resin, which binder resin is obtained by polymerizing a polymerizable monomer in the presence of the epoxy resin.

In the epoxy resin-including toner binder resin according to this invention, the epoxy resin appropriately has an epoxy equivalent in the range of 100–1000 g/equivalent weight.

Further in the epoxy resin-including toner binder resin according to this invention, the epoxy resin is appropriately contained in a proportion in the range of 1–25%, based on the total weight of the toner binder resin.

In the epoxy resin-including toner binder resin according to this invention, the polymerizable monomer appropriately is a styrenic monomer and/or a (meth)acrylic ester type monomer.

The objects mentioned above are also accomplished by a toner binder resin including an epoxy resin and a crystalline (meth)acrylic ester type polymer, which binder resin is obtained by polymerizing a polymerizable monomer in the presence of the epoxy resin and the crystalline (meth)acrylic ester polymer.

In the epoxy resin- and crystalline (meth)acrylic ester polymer-including toner binder resin according to this invention, the epoxy resin appropriately has an epoxy equivalent in the range of 100–1000 g/equivalent weight.

In the epoxy resin- and crystalline (meth)acrylic ester polymer-including toner binder resin according to this invention, appropriately the epoxy resin is contained in a proportion in the range of 1–25% and the crystalline (meth) acrylic ester type polymer is contained in a proportion in the range of 0.5–20%, based on the total weight of the toner binder resin.

In the epoxy resin- and crystalline (meth)acrylic ester polymer-including toner binder resin according to this invention, the polymerizable monomer appropriately is a styrenic monomer and/or a (meth)acrylic ester monomer.

This invention further provides a toner binder resin obtained by suspension polymerizing a polymerizable composition containing at least a polymerizable monomer and an epoxy resin in an aqueous medium, the epoxy resin being uniformly dispersed in a polymerizable monomer.

The objects mentioned above are further accomplished by a toner binder resin characterized by using as at least part of the binder resin component thereof the above mentioned epoxy resin-including binder resin or the above mentioned epoxy resin- and crystalline (meth)acrylic ester polymer-including toner binder resin.

In the static charge developing toner of this invention, the content of the epoxy resin in the toner composition appropriately is in the range of 0.5–25% by weight.

This invention further provides a static charge developing toner characterized by being obtained by suspension polymerizing in an aqueous medium a polymerizable composition containing a polymerizable monomer, and a coloring agent and/or a magnetic powder, in the presence of an epoxy resin.

This invention also provides a static charge developing toner characterized by being obtained by suspension polymerizing in an aqueous medium a polymerizable composition containing a polymerizable monomer, and a coloring agent and/or a magnetic powder, in the presence of an epoxy resin and a crystalline (meth)acrylic ester polymer.

BEST MODE FOR CARRYING OUT THE INVENTION

Now, this invention will be described more specifically below with reference to embodiments thereof.

The toner binder resin of this invention achieves the intention of imparting an improved melting property to a toner binder resin by incorporating an epoxy resin in a polymerizable monomer capable of forming a binder resin in consequence of polymerization and polymerizing the resultant blend.

After a study, the present inventors have found that an epoxy resin incorporated as a binder resin component in a toner is capable of lowering the glass transition point of the toner but that the epoxy resin, when simply added as one constituent of the binder resin component, fails to improve fully the fixing property at low temperatures and the ability to resist offset and entails degradation of the stability during storage. They have been ascertained that when an epoxy resin-including toner binder resin which is obtained by incorporating an epoxy resin in a polymerizable monomer and polymerizing the resultant blend (hereinafter referred to as "epoxy resin-including binder resin") is used as a binder resin component, the produced toner, probably because of enhanced uniform distribution of the epoxy resin in the toner particles, brings about surprising effects of imparting high stability (resistance to frictional excoriation) to a produced image at the fixing temperature, widening the nonoffset range, manifesting the low-temperature fixing property and the resistance to offset fully satisfactorily, and excelling in stability during storage.

The present inventors, after continuing the study, have found that a toner using a binder resin obtained by polymerizing a polymerizable monomer in the presence of a crystalline (meth)acrylic ester type polymer in addition to the epoxy resin mentioned above, for some unknown reason, manifests a synergistic effect of heightening the low-temperature fixing property and enlarging the nonoffset range as compared with the toner using some other offset-preventing agent.

Epoxy resin-including binder resin

The epoxy resin to be used in this invention is not limited particularly. The epoxy resins of various kinds such as, for example, bisphenol A type, halogenated bisphenol type, resorcinol type, bisphenol F type, novolac type, polyalcohol type, polyglycol type, polyolefin type, and alicyclic type which are solid or liquid at normal room temperatures (25° C.±2° C.) are available herein. The epoxy resin of the bisphenol A type is generally used. From the viewpoint of the stability of the produced toner during storage, the epoxy resin appropriately has a glass transition point (Tg) exceeding 25° C., preferably falling in the range of 30–60° C. If the molecular weight (Mn) of the epoxy resin is extremely high and exceeds 3000, for example, the possibility ensues that the polymerization of a main binder resin component to be described specifically hereinbelow for the formation of an epoxy resin-including binder resin will not profitably proceed, the produced polymer will emit the epoxy resin from the matrix thereof, and the epoxy resin will not be uniformly dispersed in the polymer matrix. Thus the molecular weight appropriately is relatively low. Properly in the case of the bisphenol A type, the epoxy equivalent is in the range of 100–1500 g/equivalent weight, preferably 100–1000 g/equivalent weight, and more preferably 400–1000 g/equivalent weight.

In the toner binder resin of this invention, the polymerizable monomer which, on being polymerized, forms a binder resin component is not particularly limited. It may be any of various vinyl monomers generally used in the field of toners. As concrete examples of the vinyl monomer usable herein, styrenic monomers such as styrene, o-methyl styrene, m-methyl styrene, p-methyl styrene, α-methyl styrene, p-methoxy styrene, p-tert-butyl styrene, p-phenyl styrene, o-chlorostyrene, m-chlorostyrene, p-chlorostyrene, and α-methyl styrene; (meth)acrylic ester type monomers such as methyl acrylate, ethyl acrylate, n-butyl acrylate, isobutyl acrylate, dodecyl acrylate, stearyl acrylate, 2-ethylhexyl acrylate, tetrahydrofuryl acrylate, methyl methacrylate, ethyl methacrylayte, propyl methacrylate, n-butyl methacrylate, isobutyl methacrylate, n-octyl methacrylate, dodecyl methacrylate, 2-ethylhexyl methacrylate, and stearyl methacrylate; olefinic monomers such as ethylene, propylene, and butylene; and acrylic acid, methacrylic acid, vinyl chloride, vinyl acetate, acrylonitrile, acrylamide, methacrylamide, and N-vinyl pyrrolidone may be cited. These polymerizable monomers may be used either singly or in the form of a combination of two or more members. Among other conceivable combinations, those which have styrenic monomers and/or (meth)acrylic ester type monomers as main components thereof prove particularly favorable. From the standpoint of low temperature fixing property and stability during storage, it is proper to form styrenic—(meth)acrylic ester type copolymers by using styrenic monomers and (meth)acrylic ester type monomers. Further from the standpoint of the thermal properties of the toner formed by using the produced binder resin, it is appropriate to form a styrene-(meth)acrylic ester mixture containing not less than 50% by weight of styrene.

The amount of the epoxy resin in the polymerizable composition during the production of the epoxy resin-including binder resin of this invention is not particularly limited. Appropriately in the epoxy resin-including binder resin which is obtained in consequence of the polymerization, the epoxy resin is incorporated in a proportion in the range of 1–25%, preferably 2–20%, based on the total weight of the binder resin. If the content of the epoxy resin is less than 1% based on the total weight of the binder resin, the static charge developing toner produced by using the resultant epoxy resin-including binder resin will not be expected to enjoy any improvement in the low-temperature fixing property or the ability to resist offset. Conversely, if the epoxy content exceeds 25%, the possibility ensues that the polymerization of the polymerizable monomer mentioned above for the formation of the main binder resin component will not profitably proceed, the binder resin produced by the polymerization will emit the epoxy resin from the matrix thereof, and the epoxy resin will not be uniformly dispersed in the binder resin matrix.

The method of polymerization to be used in the production of the epoxy resin-including binder resin of this invention does not need to be particularly limited but may be selected from among various known methods of polymerization such as suspension polymerization, emulsion polymerization, solution polymerization, and bulk polymerization. Among other methods cited above, the suspension polymerization method proves particularly favorable because this method can be expected to improve the uniform dispersibility of the epoxy resin in the produced binder resin.

The suspension polymerization is effected by suspending in an aqueous medium the polymerizable monomer composition obtained by dispersing or dissolving such an epoxy resin as described above supplied in the form of beads, for example, in such a polymerizable monomer as described above and polymerizing the suspended polymerizable monomer composition at a temperature in the range of 50–90° C., preferably 60–80° C., for example.

In the production of the epoxy resin-including binder resin by the suspension polymerization of the polymerizable monomer component as described above, the monomer component may incorporate therein other polymer such as, for example, a polyester and may suitably incorporate further therein such known additives as a chain transfer agent serving to adjust the degree of polymerization. Further, during the course of the suspension polymerization, a cross-linking agent may be used.

As concrete examples of the cross-linking agent, aromatic divinyl compounds such as divinyl benzene, divinyl naphthalene, and derivatives thereof; diethylenically unsaturated carbolic esters such as ethylene glycol dimethacrylate, diethylene glycol dimethacrylate, triethylene glycol dimethacrylate, trimethylol propane triacrylate, allyl methacrylate, t-butyl aminoethyl methacrylate, tetraethylene glycol dimethacrylate, and 1,3-butan diol dimethacrylate; divinyl compounds such as N,N-divinyl aniline, divinyl ether, divinyl sulfide, and divinyl sulfonic acid; and compounds having three or more vinyl groups may be cited.

Further, polybutadiene, polyisoprene, unsaturated polyesters, and chlorosulfonated polyolefins are also effectively usable.

In the suspension polymerization, a dispersion stabilizer may be added for ensuring stabilization of the suspended particles. As concrete examples of the dispersion stabilizer which is usable herein, water-soluble macromolecular compounds such as polyvinyl alcohol, gelatin, tragacanth, starch, methyl cellulose, carboxy methyl cellulose, hydroxy ethyl cellulose, polysodium acrylate, and polysodium methacrylate; surfactants such as sodium dodecylbenzene sulfonate, sodium tetradecyl sulfonate, sodium pentadecyl sulfonate, sodium octyl sulfonate, sodium allyl-alkyl-polyether sulfonate, sodium oleate, sodium laurate, sodium caprate, sodium caprylate, sodium caproate, potassium stearate, potassium oleate, sodium 3,3'-disulfon-diphenyl urea-4,4'-diazo-bis-amino-8-napthtol-6-sulfonate, orthocarboxybenzene-azo-dimethyl aniline, and sodium 2,2',5,5'-tetramethyl-triphenyl methane-1,1'-diazo-bis-β-naphthol disulfonate; and alginates, zein, casein, barium sulfate, calcium sulfate, barium carbonate, magnesium carbonate, calcium phosphate, talc, cray, diatomaceous earth, bentonite, titanium hydroxide, thorium hydroxide, and metal oxide powders may be cited.

The dispersion stabilizer, for the purpose of enhancing the uniform dispersibility of the epoxy resin in the produced binder resin, must be used with the composition thereof and the amount of use thereof suitable adjusted so that the binder resin particles may acquire a prescribed particle diameter such as, for example, in the range of 2–20 μm. preferably 3.5–15 μm. When a water-soluble macromolecular compound is used as the dispersion stabilizer, for example, the amount thereof to be used is properly in the range of 0.01–20% by weight, preferably 0.1–10% by weight, based on the amount of the polymerizable monomer component. When a surfactant is used, the amount thereof to be used is properly in the range of 0.01–10% by weight, preferably 0.1–5% by weight, based on the amount of the polymerizable monomer.

As the polymerization initiator to be used for the polymerization, an oil-soluble peroxide type or azo type initiator which is generally used in suspension polymerization. As concrete examples of the polymerization initiator, peroxide type initiators such as benzoyl peroxide, lauroyl peroxide, octanoyl peroxide, benzoyl orthochloroperoxide, benzoyl orthomethoxyperoxide, methylethyl ketone peroxide, diisopropyl peroxy dicarbonate, cumene hydroperoxide, cyclohexanone peroxide, t-butyl hydroperoxide, and diisopropyl benzene hydroperoxide, and 2,2'-azobis-isobutyronitrile, 2,2'-azobis(2,4-dimethylvaleronitrile), 2,2'-azobis(2,3-dimethyl butyronitrile), 2,2'-azobis (2-methyl butyronitrile), 2,2'-azobis(2,3,3-trimethyl butyronitrile), 2,2'-azobis(2-isopropyl butyronitrile), 1,1'-azobis-(cyclohexane-1-carbonitrile), 2,2'-azobis(4-methoxy-2,4-dimethyl valeronitrile), 2-(carbamoyl-azo)isobutylonitrile, 4,4'-azobis(4-cyanovaleric acid), and dimethyl-2,2'-azobisisobutyrate may be cited. The amount of the polymerization initiator to be used is properly in the range of 0.01–20% by weight, preferably 0.1–10% by weight, based on the amount of the polymerizable monomer.

During the polymerization of the epoxy resin-including binder resin, such substances as an offset preventing agent, a charge controlling agent, and the like which are allowed to be incorporated in a toner as will be described in the section "static charge developing toner" hereinbelow may be added in advance.

Binder resin including epoxy resin and crystalline (meth) acrylic ester type polymer The binder resin including an epoxy resin and a crystalline (meth)acrylic ester type polymer according to this invention (hereinafter referred to as "epoxy resin- and crystalline (meth)acrylic ester type polymer-including binder resin") is obtained by polymerizing a polymerizable monomer in the presence of an epoxy resin and a crystalline (meth)acrylic ester type polymer, namely, basically in the same manner as the "epoxy resin-including binder resin" mentioned above excepting the polymerizable monomer is polymerized in the presence of a crystalline (meth)acrylic ester type polymer in addition to the epoxy resin.

The crystalline (meth)acrylic ester type polymer to be used in this invention is not particularly limited. It may be a polymer which contains the monomer represented by the following general formula (I) as a component unit appropriately in a ratio in the range of 100–50 mol %, preferably 100–60 mol %, and more preferably 100–70 mol %.

(I)

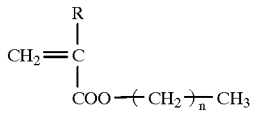

(wherein R is a hydrogen atom or a methyl group and n is an integer of 15–32, preferably 18–32, and more preferably 21–32).

As concrete examples of the monomer represented by the general formula (I) shown above, stearyl acrylate, stearyl methacrylate, hexadecyl acrylate, hexadecyl methacrylate, heptadecyl acrylate, heptadecyl methacrylate, nonadecyl acrylate, nonadecyl methacrylate, arachyl acrylate, arachyl methacrylate, behenyl acrylate, behenyl methacrylate, pentacosyl acrylate, pentacosyl methacrylate, heptacosyl acrylate [sic], heptasyl methacrylate [sic], nonocosyl acrylate nonacosyl methacrylate, dotriacontyl acrylate, and dotriasyl methacrylate may be cited. Among other monomers cited above, stearyl acrylate, behenyl acrylate, behenyl methacrylate, pentacosyl acrylate, and pentacosyl methacrylate prove particularly favorable.

As concrete examples of the monomer which is copolymerizable with the monomer represented by the general formula (I) mentioned above, styrenic monomers such as styrene, o-methyl styrene, m-methyl styrene, p-methyl styrene, α-methyl styrene, p-methoxy styrene, p-tert-butyl styrene, p-phenyl styrene, o-chlorostyrene, m-chlorostyrene, and p-chlorostyrene; noncrystalline acrylic ester type or noncrystalline methacrylic ester type monomers such as methyl acrylate, ethyl acrylate, n-butyl acrylate, isobutyl acrylate, dodecyl acrylate, n-octyl acrylate, 2-ethylhexyl acrylate, phenyl acrylate, methyl α-chloroacrylate, ethyl methacrylate, propyl methacrylate, n-butyl methacrylate, isobutyl methacrylate, n-octyl methacrylate, dodecyl methacrylate, and 2-ethylhexyl methacrylate; acrylic acid type monomers such as acrylonitrile, methacrylonitrile, and acrylamide; vinyl ether type monomers such as vinyl methyl ether, vinyl isobutyl ether, and vinyl ethyl ether; vinyl ketone type monomers such as vinyl methyl ketone, vinyl ethyl ketone, and vinyl hexyl ketone; N-vinyl compound type monomers such as N-vinyl pyrrole, N-vinyl carbazole, N-vinyl indole, and N-vinyl pyrrolidone; and various vinyl type other monomers such as ethylene, propylene, butylene, vinyl chloride, and vinyl acetate may be cited.

The weight average molecular weight of the crystalline (meth)acrylic ester type polymer appropriately is in the approximate range of 35000–500000, preferably 35000–450000, and more preferably 35000–400000. If the weight average molecular weight is less than 35000, the possibility arises that the melt viscoisity will be too low for the produced toner to exhibit such an offset preventing effect as is expected or for the crystalline (meth)acrylic ester type polymer to manifest perfect dispersibility in the binder resin or for the toner to acquire perfect stability during storage. Conversely, if the weight average molecular weight exceeds 500000, the possibility ensues that the melt viscosity will be too high and the melting properties will be too low for the ability to resist offset to be manifested as expected.

Incidentally, crystalline (meth)acrylic ester type polymers are disclosed as offset preventing agents in JP-A-06-148,936, JP-A-06-194,874, JP-A-06-194,877, etc. It is permissible to use any of those polymers disclosed therein as the offset preventing agent herein.

The production of the epoxy resin and crystalline (meth) acrylic ester type polymer-including binder resin of this invention is attained by polymerizing the same polymerizable monomer as described in the preceding section in the presence of such a crystalline (meth)acrylic ester type polymer as described above and the same epoxy resin as described in the preceding section "epoxy resin-including binder resin."

The amount of the epoxy resin to be incorporated in the polymerizable composition in the production of the epoxy resin and crystalline (meth)acrylic ester type polymer-including binder resin of this invention is not particularly limited. For the same reason as stated in the preceding section, it is appropriately incorporated in the polymerizable composition such that the binder resin obtained by the polymerization may contain the epoxy resin in an amount in the range of 1–25%, preferably 2–20%, based on the total weight of the binder resin. The amount of the crystalline (meth)acrylic ester type polymer to be added, though not particularly limited, is appropriately incorporated in the polymerizable composition such that the binder resin obtained by the polymerization will contain the crystalline (meth)acrylic ester type polymer in an amount in the range of 0.5–20%, preferably 1–15%, based on the total weight of the binder resin. If the content of the crystalline (meth) acrylic ester type polymer is less than 0.5% of the total weight of the binder resin, the effect of the addition of the crystalline (meth)acrylic ester type polymer will not be substantially perceptible because the static charge developing toner produced by using the resultant binder resin will manifest such low temperature fixing property and offset-resisting property as are not notably different from those of the toner using the epoxy resin-including binder resin described in the preceding section. Conversely, if the content of the crystalline (meth)acrylic ester type polymer exceeds 20%, the possibility arises that the polymerization of the polymerizable monomer for the formation of the main binder resin component will fail to proceed profitably, the binder resin obtained by the polymerization will emit the crystalline polymer from the matrix thereof, and the crystalline polymer will not be uniformly dispersed in the matrix.

The method of polymerization to be used in this case, though not particularly limited similarly to that described in the preceding section, may be selected from among various methods of polymerization. Among other methods available, the method of suspension polymerization proves particularly favorable because this method can be expected to improve the uniform dispersibility of the epoxy resin and the crystalline (meth)acrylic ester type polymer in the produced binder resin.

The suspension polymerization is effected by suspending in an aqueous medium the polymerizable monomer composition obtained by dispersing or dissolving such an epoxy resin supplied in the form of beads, for example, and a crystalline (meth)acrylic ester type polymer, in such a polymerizable monomer as described in the preceding section and polymerizing the suspended polymerizable monomer composition at a temperature in the range of 50–90° C., preferably 60–80° C., for example.

In the production of the epoxy resin- and crystalline (meth)acrylic ester type polymer-including binder resin by the suspension polymerization of the polymerizable monomer component as described above, the monomer component may incorporate therein other polymer such as, for example, a polyester and may suitably incorporate further therein such known additives as a chain transfer agent serving to adjust the degree of polymerization. Further, during the course of the suspension polymerization, a cross-linking agent may be used. Further, in the suspension polymerization, a dispersion stabilizer may be added for ensuring stabilization of the suspended particles. As the polymerization initiator to be used for the polymerization, an oil-soluble peroxide type or azo type initiator which is generally used in suspension polymerization. The specific examples and the amounts of addition of the polymer, additives, cross-linking agent, dispersion stabilizer, and polymerization initiator are the same as those described in the preceding section.

During the polymerization of the epoxy resin and crystalline (meth)acrylic ester type polymer-including binder resin, such substances as an offset preventing agent, a charge controlling agent, and the like which are allowed to be incorporated in a toner as will be described in the section "static charge developing toner" hereinbelow may be added in advance to the binder resin.

Static charge developing toner (1)

The static charge developing toner according to this invention can be obtained by using the epoxy resin-including binder resin and/or the epoxy resin- and crystalline (meth)acrylic ester type polymer-including binder resin as at least part of the binder resin component, suitably combining the binder resin with a coloring agent and, when necessary, other binder resin, and additives such as an offset-preventing agent, a charge controlling agent for adjusting electric charge, and a fluidizing agent which are normally used for a standard static charge developing toner, melting and kneading the blend, and then pulverizing the resultant solid mix, and classifying the produced powder. When the toner to be produced is required to be magnetic in attribute, the blend may incorporate a magnetic powder. The charge controlling agent, the fluidizing agent, and the like may be added to and attached outwardly to fine colored particles which have been obtained by pulverizing and classifying to a prescribed particle diameter a solid blend formed of the other components to give rise to the toner particles aimed at.

The other binder resin which can be used, when necessary, in the production of the static charge developing toner of this invention may be any of such resins as styrene type resin, (meth)acrylic ester type resins, styrene-(meth)acrylic ester type resins, polyester type resins, olefin type resins, polyacryl amide, and polyvinyl chloride which are normally used as toner binder resins. Among other resins mentioned above, styrenic resins, (meth)acrylic ester type resins, and styrene-(meth)acrylic ester type resins prove particularly favorable.

The amount of the epoxy resin which is ultimately contained in the toner owing to the use of the epoxy resin-including binder resin and/or the epoxy resin and crystalline (meth)acrylic ester type polymer-including binder resin in the static charge developing toner according to this invention, though not limited particularly, appropriately is such that the epoxy resin may be contained in an amount in the range of 0.5–25%, preferably 1–20% based on the total weight of the toner. If the amount of the epoxy resin to be incorporated is less than 0.5%, the improvement in the melting properties of the toner due to the addition of the epoxy resin will not be sufficient. Conversely, if this amount exceeds 25%, the excess will not proportionately improve the melting properties of the toner and will possibly impair the stability of the toner particles during storage and the stability of cohesion of the toner particles.

The coloring agent to be incorporated in the toner is any of dyes and pigments universally known to persons of ordinary skill in the art, without reference to choice between organic and inorganic substances. As concrete examples of the coloring agent usable herein, carbon black, nigrosine dye, aniline blue, calco-oil blue, chrome yellow, ultra marine blue, DuPont oil red, quinoline yellow, methylene blue chloride, phthalocyanine blue, malachite green oxalate, lamp black, oil black, azo oil black, and rose bengal may be cited. When necessary, two or more of these coloring agents may be used in combination.

As concrete examples of the magnetic powder to be added in the production of a magnetic toner, powders of such ferromagnetic metals as iron, cobalt, and nickel and powders of such metal compounds as magnetite, hematite, and ferrite may be cited. These magnetic powders function additionally as coloring agents in the production of a magnetic toner, such a magnetic power may be used as a coloring agent either independently or in combination with the dye or pigment mentioned above.

The coloring agent or the magnetic powder may be used in the unmodified form. When the coloring agent to be used has the surface thereof treated in advance by a suitable method, the produced toner is enabled to have this coloring agent uniformly dispersed therein and this toner, therefore, proves advantageous because it is capable of forming an image of high quality. When carbon black is to be used as the coloring agent, for example, the grafted carbon black such as carbon black graft polymer which has a polymer chain bound to the surface of the carbon black particles as disclosed in JP-A-63-207,767 and JP-A-63,265,913 proves appropriate. Even when a coloring agent other than carbon black is used, the surface-treated coloring agent which is obtained by the method disclosed in JP-A-01-118,573 proves appropriate.

The offset-preventing agent which is incorporated, when necessary, in the static charge developing toner of this invention, though not particularly limited, is a polyolefin or so-called polyolefin wax which has a weight average molecular weight in the approximate range or 1000–45000, preferably 2000–6000, for example. As concrete examples of the polyolefin wax, effectively usable herein, homopolymers such as polyethylene, polypropylene, and polybutylene, olefin copolymers such as ethylene-propylene copolymer, ethylene-butene copolymer, ethylene-pentene copolymer, ethylene-3-methyl-1-butene copolymer, and ethylene-propylene-butene copolymer, and copolymers of olefins with other monomers such as, for example, vinyl ethers like vinyl methyl ether, vinyl-n-butyl ether, vinyl phenyl ether, vinyl esters like vinyl acetate and vinyl butylate, haloolefins like vinyl fluoride, vinylidene fluoride, tetrafluoroethylene, vinyl chloride, vinylidene chloride, and tetrachloroethylene, (meth)acrylic esters like methyl acrylate, ethyl acrylate, n-butyl acrylate, methyl methacrylate, ethyl methacrylate, n-butyl methacrylate, stearyl methacrylate, N,N-dimethyl amino ethyl methacrylate, and t-butyl amino ethyl methacrylate, acrylic acid derivatives like acrylonitrile and N, N-dimethyl acrylamide, organic acids like acrylic acid, methacrylic acid, maleic acid, fumaric acid, and itaconic acid, and diethyl fumarate, and β-pinene may be cited.

Besides the polyolefins mentioned above, the offset-preventing agents which are usable herein include natural or synthetic paraffin waxes, particularly high-melting paraffin waxes having melting points in the range of 60–70° C., fatty acid metal salts, particularly higher fatty acid salts having not less than 17 carbon atoms, such as zinc salt, barium salt, lead salt, cobalt salt, calcium salt, and magnesium salt of stearic acid, zinc salts, manganese salts, iron salts, and lead salts of olefin acids, and zinc salt, cobalt salt, and magnesium salt of palmitic acid, higher alcohols such as myricyl alcohol, polyhydric alcohol esters such as glyceride stearate and glyceride palmitate, fatty acid esters such as myricyl stearate and myricyl palmitate, fatty partially saponified esters such as montanic partially saponified esters, higher fatty acids such as stearic acid, palmitic acid, and montanic acid; fatty acid amides such as ethylene bis-stearoyl amide, and mixtures thereof, for example.

Further, as an offset-preventing agent, such a crystalline (meth)acrylic ester type polymer as described in the preceding section "binder resin including epoxy resin and crystalline (meth)acrylic ester type polymer" may be used as separately added subsequently to the polymerization of the binder resin. The use of the crystalline (meth)acrylic ester type polymer can be expected to improve various properties such as offset-resisting property, mold release property, fluidity, and charge initiating property.

As concrete examples of the charge controlling agent, nigrosine, monoazo dye, zinc, hexadecyl succinate, alkyl esters or alkyl amides of naphthoeic acid, nitrofumic acid, N,N-tetramethyl diamine benzophenone, N,N-tetramethyl benzidine, triazine, and salicylic acid metal complexes may be cited. Such a charge controlling agent as mentioned above is more properly added externally to the resin particles obtained in consequence of the suspension polymerization than it is added during the course of the suspension polymerization.

As concrete examples of the fluidizing agent, inorganic fine particles such as colloidal silica, hydrophobic silica, hydrophobic titania, hydrophobic zirconia, and talc and organic fine particles such as polystyrene beads and (meth) acrylic resin beads may be cited.

The static charge developing toner obtained as described above has an average particle diameter in the approximate range of 2–20 $\mu$m, preferably 3.5–15 $\mu$m, for example, and has uniformly dispersed in the toner particles thereof an epoxy resin or an epoxy resin and a crystalline (meth)acrylic ester type polymer. The static charge developing toner obtained as described above has a glass transition temperature (Tg) generally in the range of 30–100° C., preferably 40–90° C., and more preferably 50–80° C.

The temperature at which the static charge developing toner according to this invention manifests a thorough fixing property is typically in the approximate range of 70–200° C., preferably in the approximate range of 100–180° C., though it depends on the kind of the main binder resin, the amount of an epoxy resin to be incorporated, and such fixing conditions as the interfacial pressure (fixing pressure) of the opposed rollers in the heating roller fixing mechanism, the rotary speed of the rollers (fixing speed), the contact width of the rollers (nip width), and the material of the rollers.

Static charge developing toner (2)

The static charge developing toner according to this invention can be obtained not only by the melting and kneading method using the epoxy resin-including binder resin and/or the epoxy resin- and crystalline (meth)acrylic ester type polymer-including bind resin as the binder resin component as described in the section "static charge developing toner (1)" above but also by the method of direct production based on the suspension polymerization.

To be specific, the static charge developing toner according to this invention can be obtained by suspending in an aqueous medium the polymerizable monomer composition obtained by dispersing or dissolving the epoxy resin, which is, for example, supplied in the form of beads, in the polymerizable monomer and polymerizing the suspended polymerizable monomer composition, when necessary, together with a further incorporated polymerizable monomer in the presence of a coloring agent and/or a magnetic powder at a temperature in the range of 50–90° C., preferably 60–80° C., for example.

The other static charge developing toner according to this invention can be obtained by suspending in an aqueous medium the polymerizable monomer composition obtained by dispersing or dissolving the epoxy resin, which is, for example, supplied in the form of beads, and the crystalline (meth)acrylic ester type polymer in the polymerizable monomer and polymerizing the suspended polymerizable monomer composition, when necessary, together with a further incorporated polymerizable monomer in the presence of a coloring agent and/or a magnetic powder at a temperature in the range of 50–90° C., preferably 60–80° C., for example.

During this suspension polymerization, the polymerizable monomer component may incorporate therein other polymer such as, for example, a polyester and may suitably incorporate further therein such known additives as a chain transfer agent serving to adjust the degree of polymerization. During the course of the suspension polymerization, a cross-linking agent may be incorporated and other components such as the offset-preventing agent and the charge controlling agent which are incorporated, when necessary, in the toner may be present in the polymerization system. Incidentally, the charge controlling agent is more properly added externally to the resin particles obtained in consequence of the suspension polymerization than it is added during the course of the suspension polymerization.

The specific examples and the amounts of addition of the polymerizable monomer, epoxy resin, crystalline (meth) acrylic ester type polymer, coloring agent, and magnetic powder to be used in the production of the static charge developing toner according to this invention by the method of suspension polymerization described above and those of other polymer, chain transfer agent, cross-linking agent, dispersion stabilizer, polymerization initiator, offset-preventing agent, and charge controlling agent to be optionally incorporated are substantially the same as those already described and will be omitted from the following description.

The amount of the epoxy resin to be incorporated, though not specifically limited, is slightly smaller than that involved in the production of the binder resin described above. Properly, this amount is such that the content of the epoxy resin may be in the range of 1–20%, preferably 2–10%, based on the total weight of the toner. The reason for this range is that in the direct production of the toner particles by the method of suspension polymerization, the conditions for the polymerization are liable to become severe owing to the presence of such substances as the coloring agent in the polymerizable monomer composition. By the same reason, the amount of the crystalline (meth)acrylic ester type polymer to be incorporated is properly such that the content of this polymer may fall in the range of 5–15%, preferably 1–10%, based on the total weight of the binder resin.

Since the suspension polymerization is intended for allowing the colored particles produced thereby to be directly used as toner particles, the reaction is appropriately performed either after the particle diameter of the suspended particles has been controlled or while the particle diameter is being controlled. It is particularly favorable to perform the reaction after the control of the particle diameter has been completed. This control of the particle diameter is effected, for example, by stirring the suspension having the prescribed component dispersed in an aqueous medium by the use of the T. K. Homomixer. It may be otherwise effected by passing the suspension at least once through such a high-speed stirrer as the line mixer (such as, for example, Ebara Milder). In consequence of this control of the particle diameter, the suspended particles prior to the suspension polymerization acquire an average particle diameter in the approximate range of 2–20 μm, preferably 3.5–15 μm.

The coloring agent and/or the magnetic powder may be added to the polymerizable monomer composition at the same time that the epoxy resin is added or at a different time from that of the addition of the epoxy resin. The same remarks hold good for the crystalline (meth)acrylic ester polymer and for other additives which are used when necessary.

After the suspension polymerization is completed, the colored particles consequently obtained are separated from the aqueous medium, dried, and optionally classified. Then, the colored particles can be used as toner particles either directly or after external addition of known additives such as the fluidizing agent and the charge controlling agent.

The static charge developing toner obtained by the method of suspension polymerization as described above assume the shape of spheres capable of controlling the average particle diameter in the range of 2–20 μm, preferably 3.5–15 μm and the particle diameter distribution in the range of 0–80%, preferably 1–50% of the coefficient of variation of particle diameter. In the individual toner particles, the epoxy resin or both the epoxy resin and the crystalline (meth)acrylic ester type polymer are uniformly dispersed.

The toner which is obtained by the method of suspension polymerization is equal or superior to the toner obtained by the melting and kneading method mentioned above in terms of such properties as the glass transition point (Tg) and the fixing property.

Now, this invention will be described more specifically below with reference to working examples. It should be noted, however, that this invention is not limited by the following examples. The terms "part" and "%" to be used in the following examples and controls refer to those expressed by weight unless otherwise specified.

EXAMPLE 1

A reaction kettle provided with a stirrer, an inert gas inlet, a reflux condenser, and a thermometer was charged with 3000 parts of deionized water having 1 part of polyvinyl alcohol dissolved in advance therein. To the deionized water in the reaction kettle was added a mixture prepared in advance by dissolving 100 parts of benzoyl peroxide in a polymerizable monomer consisting of 850 parts of styrene and 150 parts of n-butyl acrylate. They were stirred at a high speed to form a homogeneous suspension. Subsequently, the suspension was blown with nitrogen gas and heated to 85° C. and continuously stirred at this temperature for five hours to effect a polymerization reaction. Then, the reaction mixture was deprived of water to obtain a low molecular polymer having Mn=4700 and Mw=14000.

The same reaction kettle as mentioned above was charged with 8500 parts of deionized water having 5 parts of sodium dodecyl benzene sulfonate dissolved in advance therein as an anionic surfactant. To the deionized water in the reaction kettle was added a mixture which was prepared in advance by combining 100 parts of an epoxy resin of an epoxy equivalent of 435–485 g/equivalent weight (produced by Asahi Ciba K.K. and marketed under trademark designation of "Araldite AER6071"), 350 parts of the low molecular weight polymer mentioned above, 50 parts of polyethylene wax (Mn=2000), 30 parts of azobisisobutyronitrile, and 30 parts of 2,2'-azobis(2,4-dimethyl valeronitrile) with a polymerizable monomer component consisting of 822 parts of styrene, 175 parts of n-butyl acrylate, and 3 parts of divinyl benzene. They were stirred at 8000 rpm for five minutes by the use of a T. K. Homomixer (produced by Tokushu Kika Kogyo K.K.) to form a homogeneous suspension.

Then, the suspension was blown with nitrogen gas and heated to 70° C. and continuously stirred at this temperature for five hours to effect a suspension polymerization reaction. After the reaction, the suspended particles were separated by filtration and dried to obtain an epoxy resin-including binder resin (1) having Mn=7500 and Mw=122000.

In a Laboplastmill, 90 parts of the epoxy resin-including binder resin (1), 10 parts of carbon black (produced by Mitsubishi Chemical Industries, Ltd. and marketed under product code of "MA-100R"), and 2 parts of a charge controlling agent (produced by Hodogaya Chemical Co., Ltd. and marketed under trademark designation of "Aizen Spilon Black TRH") were kneaded at 100° C. for 30 minutes. The resultant blend was pulverized coarsely to below 1 mm and then finely pulverized with a jet mill and classified with a wind classifier, to obtain a static charge developing toner master powder (1) having an average particle diameter of 7.16 μm. A static charge developing toner (1) was obtained by adding 0.3 part of a hydrophobic aerosil (produced by Nippon Aerosil K.K. and marketed under product code of "R972") to 100 parts of the static charge developing toner master powder (1) and uniformly dispersing the added aerosil.

This static charge developing toner (1) was tested for glass transition point (Tg), melt flow point by a flow tester, and offset property and fixing ratio by an actual machine test. The results are shown in Table 1.

In Table 1, $T_{fb}$ represents the temperature at which the sample toner melted and began to flow in a flow tester used thereon for measurement, $T_{1/2}$ represents the temperature at which one half of the whole amount of the sample toner placed in the tester flowed, and $T_{end}$ represents the temperature at which the whole amount of the sample flowed, and the lower limit of the fixing temperature represents the level below which low temperature offset occurred and the upper limit of the fixing temperature represents the level above which high temperature offset occurred.

EXAMPLE 2

An epoxy resin-including binder resin (2) was obtained by repeating the procedure of Example 1 while using 50 parts of stearyl acrylate polymer (Mw=35000) in the place of 50 parts of polyethylene wax.

This resin had a molecular weight, Mn=7300 and Mw=135000. A static charge developing toner (2) having an average particle diameter of 8.25 m was obtained by following the procedure of Example 1 while using the epoxy resin-including binder resin (2) instead. This static charge developing toner (2) was tested for toner properties in the same manner as in Example 1. The results are shown in Table 1.

Control 1

A toner binder resin (C1) for comparison having a molecular weight, Mn=9300 and Mw=123000, was obtained by repeating the procedure of Example 1 while omitting the incorporation of the epoxy resin.

A static charge developing toner (C1) for comparison having an average particle diameter of 7.28 μm was obtained by following the procedure of Example 1 while using 90 parts of the toner binder resin (C1) for comparison, 10 parts of carbon black (produced by Mitsubishi Chemical Industries, Ltd. and marketed under product code of "MA-100R"), and 2 parts of a charge controlling agent (produced by Hodogaya Chemical Co., Ltd. and marketed under trademark designation of "Aizen Spilon Black TRH") instead.

This static charge developing toner (C1) for comparison was tested for the toner properties in the same manner as in Example 1. The results are shown in Table 1.

Control 2

A static charge developing toner (C2) for comparison having an average particle diameter of 6.95 μm was obtained by repeating the procedure of Example 1 while using 84 parts of the toner binder resin (C1) for comparison, 6 parts of an epoxy resin of an epoxy equivalent of 435–485 g/equivalent weight (produced by Asahi Ciba K.K. and marketed under trademark designation of "Araldite AER6071"), 10 parts of carbon black (produced by Mitsubishi Chemical Industries, Ltd. and marketed under product code of "MA-100R"), and 2 parts of a charge controlling agent (produced by Hodogaya Chemical Co., Ltd. and marketed under trademark designation of "Aizen Spilon Black TRH") instead.

This static charge developing toner (C2) for comparison was tested for the toner properties in the same manner as in Example 1. The results are shown in Table 1.

EXAMPLE 3

A reaction kettle provided with a stirrer, an inert gas inlet, a reflux condenser, and a thermometer was charged with 2000 parts of deionized water having 1 part of polyvinyl alcohol dissolved in advance therein. To the deionized water in the reaction kettle, a mixture prepared in advance by dissolving 80 parts of benzoyl peroxide in a polymerizable monomer consisting of 585 parts of styrene, 390 parts of butyl methacrylate, and 25 parts of glycidyl methacrylate was added. They were stirred at a high speed to form a homogeneous suspension. Subsequently, the suspension was blown with nitrogen gas and heated to 80° C. and continuously stirred at this temperature for five hours to effect a polymerization reaction. Then the resultant reaction mixture was deprived of water to obtain a polymer having epoxy group(s) as reactive group(s).

By the use of a pressure kneader, 400 parts of the polymer having the epoxy group(s) as reactive group(s), 150 parts of carbon black (produced by Mitsubishi Chemical Industries, Ltd. and marketed under product code of "MA-100R"), and 50 parts of a charge controlling agent (produced by Hodogaya Chemical Co., Ltd. and marketed under trademark designation of "Aizen Spilon Black TRH") were kneaded under the conditions of 160° C. and 100 rpm to effect a reaction. The resultant reaction mixture was cooled and pulverized, to obtain a carbon black graft polymer as a coloring agent.

The same reaction kettle as mentioned above was charged with 8970 parts of deionized water having 5 parts of sodium dodecyl benzene sulfonate dissolved in advance therein as an anionic surfactant. To the deionized water in the reaction kettle was added a mixture which was prepared in advance by combining 100 parts of an epoxy resin of an epoxy equivalent of 435–485 g/equivalent weight (produced by Asahi Ciba K.K. and marketed under trademark designation of "Araldite AER6071"), 500 parts of the carbon black graft polymer mentioned above as a coloring agent, 40 parts of polyethylene wax (Mn=2000), 30 parts of azobisisobutyronitrile, and 30 parts of 2,2'-azobis(2,4-dimethyl valeronitrile) with a polymerizable monomer component consisting of 825 parts of styrene, 175 parts of n-butyl acrylate, and 2 parts of divinyl benzene. They were stirred at 8000 rpm for five minutes by the use of a T. K. Homomixer (produced by Tokushu Kika Kogyo K.K.) to form a homogeneous suspension.

Then, the suspension was blown with nitrogen gas and heated to 70° C. and continuously stirred at this temperature for five hours to effect a suspension polymerization reaction, to obtain a suspension of fine colored spherical particles. The particles were separated by filtration and dried, to obtain fine colored particles (3) having an average particle diameter of 7.14 μm.

The colored particles (3) were used in their unmodified form as a toner. The toner was tested for glass transition point (Tg), melt flow point by a flow tester, and offset property and fixing ratio by an actual machine test. The results are shown in Table 2.

In Table 2, $T_{fb}$, $T_{1/2}$, and $T_{end}$, and the lower limit of the fixing temperature, and the upper limit of the fixing temperature have the same meanings as those shown in Table 1.

EXAMPLE 4

Fine colored particles (4) having an average particle diameter of 7.36 μm were obtained by repeating the procedure of Example 3 while changing the amount of styrene to 800 parts and that of n-butyl acrylate to 200 parts.

The colored particles (4) were used in their unmodified form as a toner. The toner was tested for the toner properties in the same manner as in Example 3. The results are shown in Table 2.

EXAMPLE 5

Fine colored particles (5) having an average particle diameter of 6.81 μm were obtained by repeating the procedure of Example 3 while using 40 parts of stearyl acrylate polymer (Mw=35000) in the place of 40 parts of polyethylene wax.

The colored particles (5) were used in their unmodified form as a toner. The toner was tested for the toner properties in the same manner as in Example 3. The results are shown in Table 2.

Control 3

Fine colored particles (C3) for comparison having an average particle diameter of 7.17 μm were obtained by repeating the procedure of Example 3 while changing the amount of styrene to 880 parts, that of n-butyl acrylate to 220 parts, and that of the epoxy resin to 0.

The colored particles (C3) were used in their unmodified form as a toner. The toner was tested for the toner properties in the same manner as in Example 1. The results are shown in Table 1.

The properties were rated as follows.

Glass transition point (Ta)

This was determined by the method for measuring differential scanning calorimetry(DSC).

Melt flow property

This property was determined by the use of a flow tester (produced by Shimadzu Seisakusho Ltd. and marketed under trademark designation of "SHIMADU FLOW-TESTER (CAPILLARY RHEOMETER) CFT-500C") under the conditions of cylinder pressure 20.0 kgf/cm$^2$, die L: 1.00 mm and D: 0.50 mm, shear stress $2.451\times10^6$ dynes/cm$^2$, and temperature increase rate 6.0° C./minute.

Nonoffset range

A sample was used in a copying device (a modified machine of "Leodry 7610", Toshiba) to produce an unfixed image having an image density of about 1.2. Then, the unfixed image was passed through a heat roller fixing device (a modified machine of "U-Bix 1805MR", Konica) to obtain a fixed image, with the fixing temperature varied to determine the presence or absence of a low temperature offset and a high temperature offset.

Fixing ratio

A sample was used in the same manner as in the rating of the nonoffset range to obtain fixed images at varying temperatures. The fixed images were tested for image density by the use of a densitometer (Macbeth RD 914). Then, by the use of an abrasion resistance tester (produced by Suga Shikenki K.K.), the fixed images were subjected to a test for abrasion resistance performed by rubbing them with a PPC cleaning pad reciprocated thereon five times. The images, after the test, were measured for image in the same manner as above. The fixing ratio at a varying temperature was calculated from the following formula using the image densities before and after the abrasion resistance test to determine the temperatures at which the fixing ratios of 70% (lowest fixing temperature) and 90% were obtained.

Fixing ratio (%)=(Image density after the abrasiontest/image density before the abrasion test)×100

Resistivity, log ρ

This was determined by the use of an automatic dielectric loss tester (produced by Ando Denki K.K. and marketed under product code of "TR-1100").

By comparing the results of Example 1 and Control 1 shown in Table 1, it is confirmed that the product of Example 1 containing an epoxy resin in consequence of the incorporation of an epoxy resin-including binder resin had an enlarged nonoffset range, enjoyed mild fixing conditions demanded by such means as a copying device, and permitted fixation at a low temperature as compared with the product of Control 1 containing no epoxy resin. The product of Example 2 containing stearyl acrylate polymer in combination with an epoxy resin had a larger nonoffset range than the product of Example 1. The product of Control 2 containing an epoxy resin in the same amount as the product of Example 1, though enjoying a slight improvement in the low-temperature fixing property, had a rather narrow nonoffset range and imposed severe fixing conditions on a copying device, for example, as compared with the product of Control 1. It further suffered ununiform dispersion of carbon black (CB) and had the possibility of dispersing the charging property and the fixed image density.

TABLE 2

| | | Example 3 | Example 4 | Example 5 | Control 3 |
|---|---|---|---|---|---|
| Fine colored particles | | (3) | (4) | (5) | (C3) |
| Glass transition point (Tg) | | 59.6° C. | 57.0° C. | 60.6° C. | 59.1° C. |
| Melt flow property | $T_{fb}$ | 107.9° C. | 106.6° C. | 108.5° C. | 108.4° C. |
| | $T_{1/2}$ | 142.4° C. | 138.1° C. | 144.1° C. | 139.2° C. |
| | $T_{end}$ | 151.4° C. | 144.4° C. | 153.3° C. | 145.7° C. |
| Nonoffset range | Lower limit of fixing temperature | 130° C. | 120° C. | 120° C. | 125° C. |
| | Upper limit of fixing temperature | ≦230° C. | 220° C. | ≦230° C. | 225° C. |
| Fixing property | 70% of fixing ratio | 130° C. | 120° C. | 125° C. | 130° C. |

TABLE 1

| | Binder resin | | Example 1 (1) | Example 2 (2) | Control 1 (C1) | Control 2 (C2) |
|---|---|---|---|---|---|---|
| Ratio of toner combination | (Ratio of combination of (binder resin) | | | | | |
| | Poly(styrene-butyl acrylate) | | 60 parts | 60 parts | 64.3 parts | 60 parts |
| | Low molecular polymer | | 21 parts | 21 parts | 32.5 parts | 21 parts |
| | Polyethylene wax | | 3 parts | — | 3.2 parts | 3 parts |
| | stearyl acrylate polymer | | — | 3 parts | — | — |
| | Expoxy resin | | 6 parts | 6 parts | — | — |
| | Epoxy resin | | — | — | — | 6 parts |
| | Carbon black | | 10 parts | 10 parts | 10 parts | 10 parts |
| | Charge controlling agent | | 2 parts | 2 parts | 2 parts | 2 parts |
| Thermal properties | Glass transition point (Tg) | | 61.2° C. | 62.7° C. | 60.6° C. | 59.8° C. |
| | Melt flow property | $T_{fb}$ | 106.0° C. | 107.2° C. | 106.4° C. | 103.9° C. |
| | | $T_{1/2}$ | 131.9° C. | 132.7° C. | 132.3° C. | 130.3° C. |
| | | $T_{end}$ | 136.6° C. | 139.9° C. | 137.1° C. | 135.1° C. |
| Fixing properties | Nonoffset range | Lower limit of fixing temperature | 125° C. | 125° C. | 125° C. | 125° C. |
| | | Upper limit of fixing temperature | 225° C. | ≦230° C. | 210° C. | 205° C. |
| | Fixing property 70% of fixing ratio | | 135° C. | 135° C. | 140° C. | 135° C. |
| | Fixing property 90% of fixing ratio | | 140° C. | 140° C. | 150° C. | 145° C. |
| Electric properties | State of dispersion of carbon black (by TEM photography) | | uniform | uniform | uniform | not uniform |
| | Resistivity log ρ | | 11.1 | 11.1 | 11.1 | 10.8 |

TABLE 2-continued

| | Example 3 | Example 4 | Example 5 | Control 3 |
|---|---|---|---|---|
| 90% of fixing ratio | 140° C. | 125° C. | 135° C. | 140° C. |

By comparing the results of Example 3 and Control 3 whose toners were nearly equal in Tg as shown in Table 2, it is found clearly that the product of Example 3 which lowered Tg by the incorporation of an epoxy resin showed an enlarged nonoffset range and allowed mild fixing conditions imposed on a copying device. By comparing the results of Example 4 and Control 3 whose toners had nearly equal nonoffset ranges as shown in Table 2, it is clearly noted that the product of Example 4 which lowered Tg by the incorporation of an epoxy resin attained a prescribed fixing ratio at a lower temperature and excelled in fixability at low temperatures. By comparing the results of Example 5 and Control 3 shown in Table 2, it is clearly found that the product of Example 5 which incorporated therein an epoxy resin and stearyl acrylate polymer enjoyed an enlarged nonoffset range and accomplished a prescribed fixing ratio at a still lower temperature in spite of a high Tg.

Industrial Applicability

The epoxy resin-including binder resin of this invention, as described above, is obtained by polymerizing a polymerizable monomer in the presence of an epoxy resin. The static charge developing toner produced by using this epoxy resin-including binder resin as at least part of the binder resin component thereof enables a fixed image stable at low temperatures to be formed without entailing offset.

The epoxy resin and crystalline (meth)acrylic ester type polymer-including binder resin of this invention is obtained by polymerizing a polymerizable monomer in the presence of an epoxy resin and a crystalline (meth)acrylic ester type polymer. The static charge developing toner produced by using this epoxy resin and crystalline (meth)acrylic ester type polymer-including binder resin as at least part of the binder resin component thereof enables a fixed image stable at still lower temperatures to be formed with the nonoffset range further enlarged as compared with the epoxy resin-including binder resin.

The toner of this invention is obtained by using the epoxy resin-including binder resin and/or the epoxy resin and crystalline (meth)acrylic ester type polymer-including binder resin as at least part of the binder resin component thereof. Probably because the uniform dispersion of the epoxy resin in the toner particles is consequently ensured, this toner enjoys excellent stability during storage even when the epoxy resin used therein has a relatively low molecular weight and a relatively low Tg (such as, for example, about 30–60° C.) and manifests fully satisfactory properties as compared with the toner which is obtained by simply melting and kneading with an epoxy resin a binder resin including no epoxy resin. When the epoxy resin and crystalline (meth)acrylic ester type polymer is used, the synergistic effect of further exalting the effect of fixing the toner at low temperatures and enlarging the nonoffset range as well is attained.

The toner of this invention is also obtained by suspension polymerizing in an aqueous medium the polymerizable composition containing a polymerizable monomer and a coloring agent and/or a magnetic powder in the presence of an epoxy resin or in the presence of an epoxy resin and a crystalline (meth)acrylic ester type polymer. This toner likewise enables a fixed image stable at low temperatures to be formed without entailing offset.

The static charge developing toner obtained with the toner binder resin according to this invention, therefore, is fit for embodying the efforts to lower power consumption and heighten operational speed in the field of electrophotography, static recording, and static printing.

We claim:

1. A toner binding resin comprising a polymer obtained by polymerizing a polymerizable monomer in the presence of an epoxy resin and a crystalline (meth)acrylic ester polymer, wherein said binding resin contains 1–25% of said epoxy resin and 0.5–20% of said crystalline (meth)acrylic ester polymer, based on the total weight of said binding resin.

2. A toner binder resin according to claim 1, wherein said epoxy resin has an epoxy equivalent in the range of 100–1000 g/equivalent weight.

3. A toner binder resin according to claim 1, wherein said polymerizable monomer is a styrenic monomer, a (meth) acrylic ester type monomer, or a combination thereof.

4. A toner binder resin according to any of claims 1, 2 and 3, wherein said binder resin is obtained by suspension polymerizing in an aqueous medium a polymerizable monomer composition containing at least said polymerizable monomer, said epoxy resin, and said crystalline (meth) acrylic ester polymer, wherein said epoxy resin and said crystalline (meth)acrylic ester type polymer being uniformally dispersed in said polymerizable monomer.

5. A static charge developing toner, characterized by using the toner binding resin set forth in any of claims 1–3 as part of at least the binding resin component, wherein said toner contains 0.5–25% epoxy resin, based on the total weight of said toner, and 0.5–20% of said crystalline (meth)acrylic ester polymer, based on the total weight of said binding resin component.

6. A static charge developing toner comprising a polymer obtained by suspension polymerizing in an aqueous medium a polymerizable monomer composition containing a polymerizable monomer, a coloring agent, and, optionally, a magnetic powder in the presence of an epoxy resin and a crystalline (meth)acrylic ester type polymer, wherein said toner contains 1–20% of said epoxy resin, based on the total weight of said toner, and 5–15% of said crystalline (meth) acrylic ester polymer, based on the total weight of said binding resin component.

7. A toner binder resin according to claim 2, wherein said polymerizable monomer is a styrenic monomer, a (meth) acrylic ester type monomer, or a combination thereof.

* * * * *